US008448705B2

(12) United States Patent
Coffin et al.

(10) Patent No.: US 8,448,705 B2
(45) Date of Patent: May 28, 2013

(54) METHODS OF PREVENTING PREMATURE FRACTURING OF A SUBTERRANEAN FORMATION USING A SHEATH

(75) Inventors: Maxime P. Coffin, Pau (FR); Patrick P. Bourgneuf, Pau (FR); Andrew D. Penno, Pau (FR)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/483,413

(22) Filed: May 30, 2012

(65) Prior Publication Data

US 2013/0081810 A1 Apr. 4, 2013

Related U.S. Application Data

(63) Continuation of application No. PCT/US2011/054604, filed on Oct. 3, 2011.

(51) Int. Cl.
*E21B 43/04* (2006.01)
*E21B 43/26* (2006.01)

(52) U.S. Cl.
CPC ..... *E21B 43/04* (2013.01); *E21B 43/045* (2013.01)
USPC ..... 166/278; 166/305.1; 166/51; 166/228

(58) Field of Classification Search
USPC ..... 166/278, 305.1, 381, 51, 227, 228
See application file for complete search history.

(56) References Cited

U.S. PATENT DOCUMENTS

| | | | | |
|---|---|---|---|---|
| 3,830,294 | A * | 8/1974 | Swanson, Jr. | 166/51 |
| 4,685,519 | A * | 8/1987 | Stowe et al. | 166/278 |
| 4,945,991 | A | 8/1990 | Jones | |
| 5,330,003 | A * | 7/1994 | Bullick | 166/278 |
| 6,644,406 | B1 | 11/2003 | Jones | |
| 6,932,157 | B2 | 8/2005 | McGregor et al. | |
| 2008/0142227 | A1 | 6/2008 | Yeh et al. | |
| 2009/0255686 | A1 | 10/2009 | Richard et al. | |

* cited by examiner

*Primary Examiner* — Cathleen Hutchins
(74) *Attorney, Agent, or Firm* — Paul Herman; Sheri Higgins Law

(57) ABSTRACT

A method of completing at least a portion of an open-hole wellbore comprises: positioning a sand control assembly in the portion of the open-hole wellbore, wherein the sand control assembly comprises a screen; positioning at least one conduit adjacent to the sand control assembly; positioning a sheath in the portion of the open-hole wellbore, wherein the sheath is a non-porous tubular, and wherein the sheath is positioned such that a sheath annulus exists between the inside wall of the sheath and the outside wall of at least a portion of both, the sand control assembly and the at least one conduit; and introducing a treatment fluid into the portion of the open-hole wellbore.

20 Claims, 2 Drawing Sheets

METHODS OF PREVENTING PREMATURE FRACTURING OF A SUBTERRANEAN FORMATION USING A SHEATH

CROSS-REFERENCE TO RELATED APPLICATION

This application is a continuation of International Application No. PCT/US11/54604, filed Oct. 3, 2011.

TECHNICAL FIELD

Methods of completing at least a portion of an open-hole wellbore are provided. In certain embodiments the completion technique is gravel packing or fracturing. A sheath can be placed in the open-hole portion of the wellbore such that it surrounds any cross-over tool ports and the top of a screen and at least one conduit, commonly called a shunt tube. The sheath can function to prevent premature fracturing of a subterranean formation should a sufficient amount of pressure build up in the conduit due to the formation of a bridge.

SUMMARY

According to an embodiment, a method of completing at least a portion of an open-hole wellbore comprises: positioning a sand control assembly in the portion of the open-hole wellbore, wherein the sand control assembly comprises a screen; positioning at least one conduit adjacent to the sand control assembly; positioning a sheath in the portion of the open-hole wellbore, wherein the sheath is a non-porous tubular, and wherein the sheath is positioned such that a sheath annulus exists between the inside wall of the sheath and the outside wall of at least a portion of both, the sand control assembly and the at least one conduit; and introducing a treatment fluid into the portion of the open-hole wellbore.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
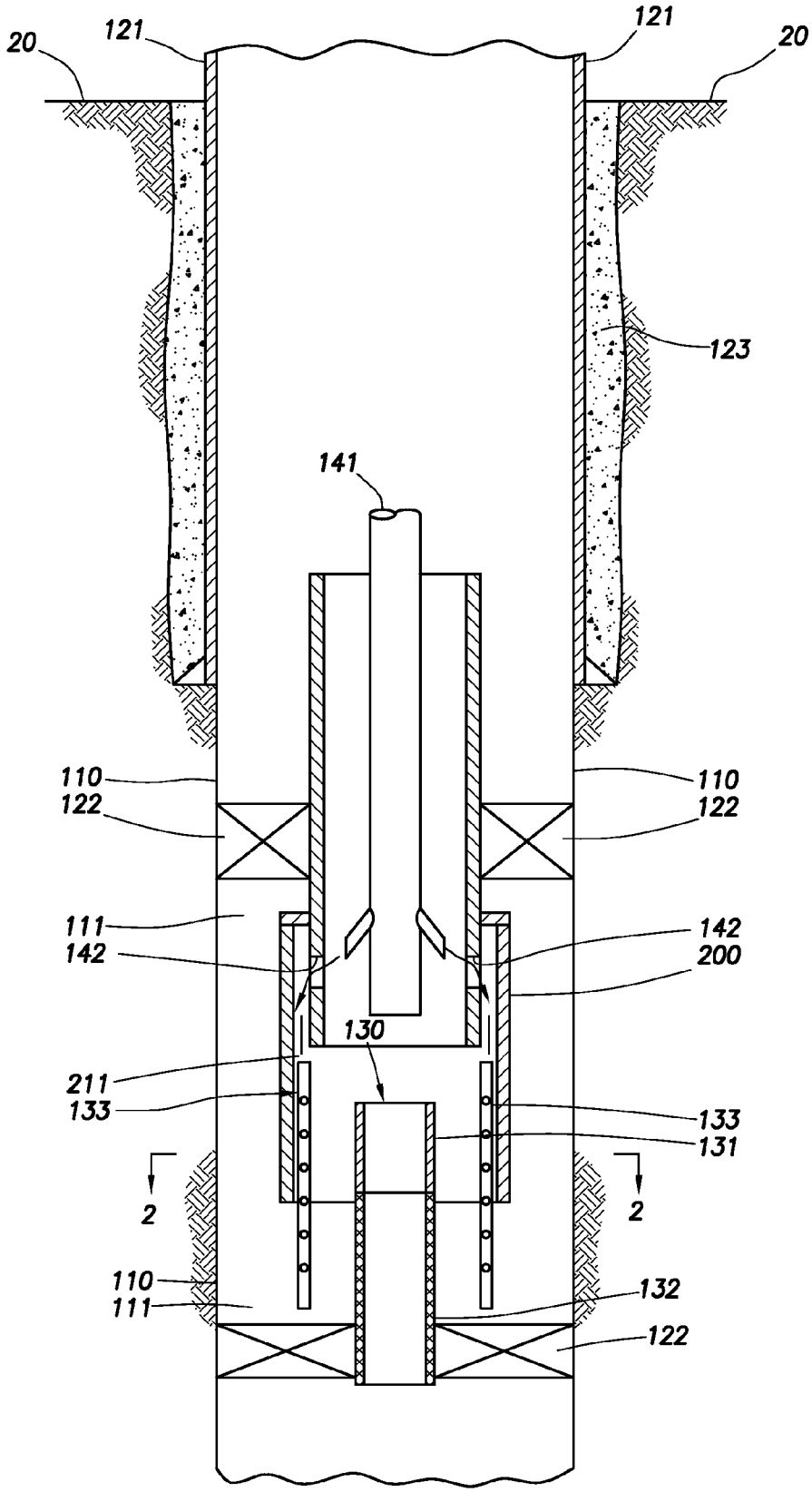
FIG. 1 is a diagram of a well system including a conduit and a sheath.
Figure 2:
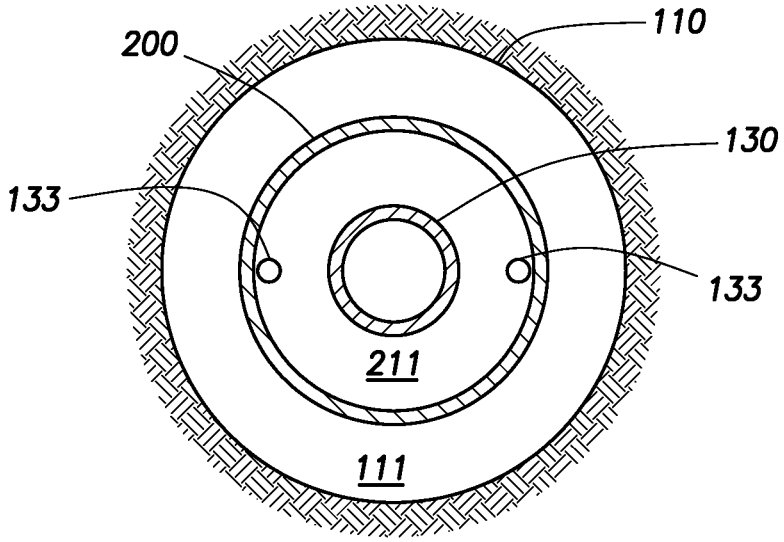
FIG. 2 is a cross-sectional view taken along lines 1-1 of FIG. 1.

As used herein, the words "comprise," "have," "include," and all grammatical variations thereof, are each intended to have an open, non-limiting meaning that does not exclude additional elements or steps.

It should be understood that, as used herein, "first," "second," "third," etc., are arbitrarily assigned and are merely intended to differentiate between two or more packers, openings, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase. A colloid is an example of a heterogeneous fluid. A colloid can be: a slurry, which includes a continuous liquid phase and undissolved solid particles as the dispersed phase; an emulsion, which includes a continuous liquid phase and at least one dispersed phase of immiscible liquid droplets; or a foam, which includes a continuous liquid phase and a gas as the dispersed phase.

As used herein, the words "treatment" and "treating" mean an effort used to resolve a condition of a well. Examples of treatments include, for example, completion, stimulation, isolation, or control of reservoir gas or water.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, or water production well or an injection well. As used herein, a "well" includes at least one wellbore. A wellbore can include vertical, angled, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within about 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore which can also contain a tubing string. A wellbore can contain an annulus. Examples of an annulus include, but are not limited to: the space between the wall of the wellbore and the outside of a tubing string in an open-hole wellbore; the space between the wall of the wellbore and the outside of a casing in a cased-hole wellbore; and the space between the inside of a casing and the outside of a tubing string in a cased-hole wellbore. A wellbore can also contain both, a cased-hole portion and an open-hole portion. In this example, the wellbore can contain two annuli; one between the wall of the wellbore and the outside of a tubing string, and the other between the wall of the wellbore and the outside of the casing or between the inside of the casing and the outside of the tubing string.

For open-hole wellbore portions, fines, such as sediment and sand, can enter the tubing string during the production of oil or gas. When this occurs, several problems can arise, such as, erosion of production equipment, well plugging, decreased production of oil or gas, or production of the fines along with the oil or gas.

Sand control techniques are often used in open-hole wellbore portions. Examples of sand control techniques include, but are not limited to, using slotted liners and/or screens and gravel packing. A slotted liner can be a perforated pipe, such as a blank pipe. A screen usually contains holes that are smaller than the perforations in the slotted liner. The liner and/or screen can cause bridging of the fines against the liner or screen as oil or gas is being produced.

Gravel packing is often performed in conjunction with the use of slotted liners and screens. Gravel can have a largest dimension ranging from 0.2 millimeters (mm) up to 2.4 mm. Gravel is commonly part of a slurry in which a carrier liquid makes up the continuous phase of the slurry and the gravel comprises the dispersed phase of the slurry. In gravel packing operations, the slurry is pumped into at least a portion of a wellbore. The portion of the wellbore to be gravel packed can be a cased-hole portion or open-hole portion of the wellbore. In order to isolate the portion of the wellbore to be gravel packed, a first packer can be placed at a location above the zone of interest and a second packer can be placed at a location below the zone of interest. In this manner, the gravel slurry can be placed in the zone of interest. For a cased-hole portion, the gravel slurry can be placed in the annulus between the wall of the wellbore and the outside of the casing, in the annulus between the inside of the casing and the outside of the tubing, screen string, or both. For an open-hole portion, the gravel slurry can be placed in the annulus between the wall of the wellbore and the outside of the tubing and/or screen.

As the gravel slurry is placed in the zone of interest, at least some of the liquid continuous phase can flow into the screen and into a washpipe, where the liquid is returned to surface. The liquid continuous phase can also flow into a portion of the subterranean formation. As a result, the gravel can remain in the zone of interest. The remaining gravel functions to maintain the stability of an open-hole wellbore portion by helping to prevent the wall of the wellbore from sloughing or caving into the annular space between the wall of the wellbore and the screen. Moreover, once placed in the zone of interest, the gravel can also help to control reservoir solids from entering the production equipment or plugging the porous portions of the liner or screen.

Another common completion technique is called fracturing. A treatment fluid adapted for this purpose is sometimes referred to as a fracturing fluid. The fracturing fluid is pumped at a sufficiently high flow rate and high pressure into the wellbore and into the subterranean formation to create or enhance a fracture in the subterranean formation. Creating a fracture means making a new fracture in the formation. Enhancing a fracture means enlarging or extending a pre-existing fracture in the formation. Packers are commonly used with fracturing techniques, thus enabling fracturing in a desired zone of the wellbore.

A newly-created or extended fracture will tend to close together after the pumping of the fracturing fluid is stopped. To prevent the fracture from closing completely, a material must be placed in the fracture to keep the fracture propped open. A material used for this purpose is often referred to as a "proppant."

The proppant is in the form of a solid particulate, which can be suspended in the fracturing slurry, carried downhole, and deposited in the fracture as a "proppant pack." The proppant pack props the fracture in an open condition while allowing fluid flow through the permeability of the pack. The size of proppant is generally classified wherein at least 90% of the proppant has one size in the range from 0.2 mm to 2.4 mm.

Several problems can occur during treatment operations, such as gravel packing or fracturing. A common problem is the formation of one or more bridges in a portion of the annulus to be treated. As a slurry (e.g., a gravel-pack fluid or fracturing fluid) is pumped into the well, the liquid continuous phase tends to flow into other portions of the well away from the annulus. The gravel or proppant is then deposited in the annulus. In an ideal gravel-packing situation, the gravel is often placed in the portion of the annulus to be packed, either from the top down or from the bottom up. As used herein, the term "top" refers to a location within a wellbore that is closest to the wellhead when compared to the bottom. As used herein, the term "bottom" refers to a location within a wellbore that is farther away from the wellhead when compared to the top. The gravel will gradually build upon itself and fill the annular space in this ideal situation. In an ideal fracturing situation, the proppant will naturally flow towards and through the path of least resistance and fill the space within the newly-created or extended fractures. However, it is not uncommon for the gravel or proppant to prematurely build upon itself in an undesired location. This is commonly called the formation of a bridge.

For gravel-packing operations, if the bridge forms at a location in the zone of interest above the packing job for a top down operation, then the slurry can be prohibited from flowing down to the area below the bridge. Conversely, if the bridge forms at a location in the zone of interest below the packing job for a bottom up operation, then the slurry can be prohibited from flowing up to the area above the bridge. Moreover, for fracturing operations, if the bridge forms above or below the desired location in the annulus, then the fracturing fluid and proppant can be prohibited from creating, extending, or filling a fracture.

Several devices and techniques have been developed to overcome bridge formation. An example of a device is a conduit, commonly called a shunt tube or alternate flow path. The shunt tube can be placed co-axially to, and run at least a sufficient length alongside, a sand screen and tubing assembly. The diameter of the shunt tube is generally smaller than the diameter of the annulus in the zone of interest. The shunt tube can also be a combination of a transport tube and a packing tube. The transport tube is generally one piece of conduit that spans the entire length of the tubing string. The packing tube, by contrast, is generally made up of several different sections of conduits, wherein each section is operatively connected to one section of tubing string via a connection to the transport tube. Upon initial pumping of the treatment fluid, the fluid will tend to flow into the path of least resistance, which due to the larger diameter, is often the annulus. However, if a bridge forms in the annulus, then a back pressure can occur at a point above or below the bridge depending on whether the operation is top down or bottom up. This back pressure can force at least some of the treatment fluid to enter the shunt tube. The shunt tube commonly includes perforations such that as the treatment fluid flows into the tube, into a packing tube if a packing tube is used, and then the fluid can exit the tube at the location of the perforations. The fluid can then flow into the portions of the annulus above or below the bridge, and the operation can continue.

When the fluid entrance to the shunt tube is located in an open-hole portion of the wellbore, premature fracturing of the subterranean formation can occur. This can occur because a back pressure can build up in the shunt tube as the fluid flows into the tube. The amount of back pressure is proportional to the length of the tube. For example, as the length of the shunt tube increases, the amount of back pressure also increases. The amount of back pressure is also inversely proportional to the diameter of the tube. For example, as the diameter of the shunt tube decreases, the amount of back pressure increases. In some cases, the back pressure can increase to the point where the fluid no longer enters the tube, but rather is forced under the pressure outwardly in a direction towards the wall of the wellbore. The pressure at which the fluid is outwardly-forced can be great enough that a fracture is created. When the shunt tube entrance is located in a cased-hole portion of the wellbore, the casing can act as a barrier to the forced outwardly flow or increasing pressure. The fluid, in this example, is forced outwardly in the direction towards the inside wall of the casing. As such, the casing prevents the fluid from contacting the wall of the wellbore and prevents the premature fracturing of the subterranean formation.

There is a need to prevent premature fracturing of a formation when performing gravel-packing or fracturing operations in an open-hole portion of a wellbore that includes one or more shunt tubes. It has been discovered that a sheath, placed in a specific location, can be used to prevent premature fracturing of a formation in these open-hole wellbore operations.

According to an embodiment, a method of completing at least a portion of an open-hole wellbore comprises: positioning a sand control assembly in the portion of the open-hole wellbore, wherein the sand control assembly comprises a screen; positioning at least one conduit adjacent to the sand control assembly; positioning a sheath in the portion of the open-hole wellbore, wherein the sheath is a non-porous tubular, and wherein the sheath is positioned such that a sheath annulus exists between the inside wall of the sheath and the outside wall of at least a portion of both, the sand control assembly and the at least one conduit; and introducing a treatment fluid into the portion of the open-hole wellbore.

Any discussion of a particular component of the well system (e.g., a conduit) is meant to include the singular form of the component and also the plural form of the component, without the need to continually refer to the component in both the singular and plural form throughout. For example, if a discussion involves "the conduit," it is to be understood that the discussion pertains to one conduit (singular) and two or more conduits (plural). It is also to be understood that any discussion of a particular component or particular embodiment regarding a component is meant to apply to all of the method embodiments without the need to re-state all of the particulars for each of the method embodiments.

Turning to the Figures. FIG. 1 is a diagram of a well system 10. The well system includes a wellbore 110. The wellbore 110 can extend into the ground at the wellhead 20. At least a portion of the wellbore 110 is open hole. The wellbore 110 can include a casing 121. The casing 121 can be cemented in place using a cement 123.

The open-hole portion of the wellbore 110 can be located in an unconsolidated, loosely-consolidated, or consolidated formation. According to an embodiment, the open-hole portion of the wellbore 110 is to be treated. The treatment can be an operation in which bridge formation can occur, for example, a gravel-packing or fracturing operation. The treatment can also be an operation in which bridge formation can occur, and when a shunt tube is used. The gravel-packing operation can be a top down or bottom up operation. There can also be more than one treatment performed in the open-hole portion. There can also be more than one portion of an open-hole portion of the wellbore 110 to be treated. For example, the open-hole portion of the wellbore 110 can include two or more zones to be treated. In this instance, some or all of the zones can be treated. In order to create one or more zones in a wellbore, it is common to separate one zone from another zone via a packer. The wellbore 110 can further include a packer 122. The wellbore 110 can also include two or more packers 122. The packer 122 can be used to create the open-hole portion(s) of the wellbore 110 to be treated.

The well system 10 can further include a cross-over tool (not shown). The cross-over tool can be operatively connected to a tubing string 141, for example a wash pipe. The cross-over tool can include two or more cross-over tool ports 142. A treatment fluid can be introduced into the portion of the wellbore 110 via the tubing string 141 and the cross-over tool ports 142.

The methods include the step of positioning a sand control assembly 130 in the portion of the open-hole wellbore 110. There are various techniques that can be used to position the sand control assembly 130 and one of skill in the art will be able to determine the best technique depending on the specific conditions of the well. The sand control assembly 130 includes at least a screen 132. The screen 132 can be, and is generally, porous. The pores or slots of the screen 132 can allow fluids, such as a liquid or a gas, to flow into or from the screen 132 while reducing or preventing the migration of solids, such as sand or fines, from entering the screen. The sand control assembly 130 can further include a blank pipe 131. The blank pipe 131 may or may not be perforated. The blank pipe 131 can be connected to the screen 132 at a location above the top of the screen 132 for top down packing, at a location below the bottom of the screen 132 for bottom up packing, or at any location between joints of the screen.

The well system 10 also includes at least one conduit 133 (commonly called a shunt tube). The well system 10 can also include two or more conduits 133. The conduit 133 can be a hollow tube. According to an embodiment, the conduit 133 has a length substantially the same as the sand control assembly 130. According to another embodiment, the conduit 133 has a length substantially the same as the screen 132. The conduit 133 does not have to be exactly the same length as the sand control assembly 130 or the screen 132. For example, the conduit 133 can be shorter or longer than the assembly 130 or screen 132. The conduit 133 is preferably aligned co-axially with the sand control assembly 130. In this manner, the conduit 133 is oriented parallel to the sand control assembly 130 and runs alongside the sand control assembly 130. The conduit 133 can be positioned in the portion of the open-hole wellbore 110 such that a space, alternatively no space, exists between the conduit 133 and the outside wall of the sand control assembly 130. The conduit 133 preferably includes multiple pores or ports. In this manner, a fluid can flow through the conduit 133 and exit the conduit 133 via the pores. The pores or ports can have various shapes and sizes including, but not limited to, tubular, rectangular, pyramidal, or curlicue. The pores or ports of the conduit 133 can be arranged in various ways along the length of the conduit 133. By way of example, if a space exists between the conduit 133 and the sand control assembly 130, then the pores can be oriented circumferentially around the conduit 133 along a desired length of the conduit 133. By way of another example, if no space exists between the conduit 133 and the sand control assembly 130, then the pores can be oriented along the wall of the conduit 133 that faces the wall of the wellbore 110 for a desired length along the conduit 133. In this example, fluid can flow out of the pores in the direction of the wall of the wellbore 110.

After the sand control assembly 130 has been positioned in the portion of the open-hole wellbore 110, a wellbore annulus 111 can exist. The wellbore annulus 111 can be the space between the wall of the open-hole wellbore 110 and the outside wall of the sand control assembly 130. According to an embodiment, the diameter of the conduit 133 is smaller than the diameter of the wellbore annulus 111. Because fluid flow tends to follow the path of least resistance, a fluid will tend to begin flowing into the wellbore annulus 111 before it flows into the conduit 133. The conduit 133 can include a first opening at one end, and can further include a second opening at the other end. It is to be understood that the first and second openings are not the pores. The openings can be located at either end of the conduit 133, whereas the pores will be located along the wall of the conduit 133. There can also be more than one opening at either of the two ends. According to an embodiment, the conduit 133 does not contain a second opening, and fluid can flow into the first opening(s). The first opening can be appropriately-positioned in the wellbore 110 depending on whether the operation is a top-down or bottom-up operation. According to an embodiment, the first opening is positioned adjacent to the cross-over tool ports 142. For example, and as can be seen in FIG. 1, the first opening can be located a desired distance below the cross-over tool ports 142. The first opening can also be located above the cross-over tool ports 142 for bottom up packing. The first opening is also preferably positioned adjacent to the blank pipe 131 or screen 132.

The methods also include the step of positioning a sheath 200 in the portion of the open-hole wellbore 110. The sheath 200 is a non-porous tubular. The sheath 200 can have a variety of shapes including, but not limited to, tubular, rectangular, pyramidal, or curlicue. The sheath 200 includes two openings. The sheath 200 is positioned such that a sheath annulus 211 exists between the inside wall of the sheath 200 and the outside wall of at least a portion of both, the screen 132 and the conduit 133. By way of example, the sheath 200 can be positioned such that the sheath 200 begins at a point above the cross-over tool ports 142 and ends at a point below the top of the screen 132 for top down packing. By way of another example, the sheath 200 can be positioned such that the sheath 200 begins at a point below the cross-over tool ports 142 and ends at a point above the bottom of the screen 132 for bottom up packing.

The sheath 200 can be a variety of lengths and circumferences. According to an embodiment, the length of the sheath 200 is at least sufficient to encircle the cross-over tool ports 142 and the beginning (i.e., the top or bottom) of the screen 132. According to another embodiment, the length of the sheath 200 is at least sufficient to span from a point above (or below) the cross-over tool ports 142 to a point below (or above) the top (or bottom) of the screen 132 (depending on whether top down or bottom up gravel packing is being performed). The sheath 200 can have a length of at least 4 feet (ft.), alternatively in the range of about 30 ft. to about 60 ft., and alternatively in the range of about 30 ft. to about 200 ft. Where the sheath 200 begins at the cross-over tool ports 142 point can vary. Moreover, where the sheath 200 ends at the screen 132 point can vary. Either one of the cross-over tool ports 142 or the screen 132 points can range from about 1 foot to about 20 feet. According to an embodiment, the circumference of the sheath 200 is at least sufficient to encircle at least the cross-over tool ports 142, the screen 132, and the conduit 133.

Preferably, the first opening of the conduit 133 is located within the sheath annulus 211. The following example illustrates one possible scenario for using the sheath 200 in the portion of the open-hole wellbore 110. The sand control assembly 130 can be positioned in at least one portion of an open-hole wellbore 110. The sheath 200 is positioned in the open-hole portion of the wellbore 110. The sheath 200 is positioned such that it surrounds at least the cross-over tool ports 142 and the top (or bottom) of the screen 132. After the sheath 200 is positioned, a sheath annulus 211 exists between the inside wall of the sheath 200 and the outside walls of the screen 132 and the conduit 133. A treatment fluid is introduced into the well via the tubing string 141 and the cross-over tool ports 142. The treatment fluid can flow in the direction of the arrows in FIG. 1 and will normally enter the largest diameter opening. Because the wellbore annulus 111 has a larger diameter than either the sheath annulus 211 or the conduit 133, the treatment fluid will tend to naturally flow into the wellbore annulus 111. Some of the fluid can flow into the sheath annulus 211 and/or the conduit 133; however, the majority of the fluid will tend to flow into the wellbore annulus 111. If for some reason a bridge develops in the wellbore annulus 111, then a back pressure can develop within the wellbore annulus 111. The back pressure can cause the fluid to increasingly flow into the sheath annulus 211. As the liquid portion of the treatment fluid disperses in other areas of the wellbore 110, the solid portion of the fluid can build up in the sheath annulus 211. The bridge formation in the sheath annulus 211 can cause a back pressure to build up inside the sheath annulus 211. The sheath annulus back pressure can cause the fluid to increasingly flow into the conduit 133. The fluid in the conduit 133 can then flow out into the portions of the wellbore annulus 111 that are not blocked by the bridge. The wellbore treatment can now be completed. In the event that a bridge develops in the conduit 133, a back pressure can build up in the conduit 133. The back pressure can force the fluid in an outwardly direction. The sheath 200 can be designed such that it is capable of withstanding the fluid force caused by the back pressure from the blocked conduit 133. As a result, the sheath 200 shields the wall of the wellbore 110 and prevents the subterranean formation from fracturing prematurely.

According to an embodiment, the sheath 200 is capable of withstanding the fluid pressure from the first opening of a conduit 133 that has become blocked or flow constrained by a bridge. As used herein, reference to the sheath 200 being able to "withstand" a certain pressure means that the wall of the sheath 200 does not become severely deformed or punctured from the pressure to such an extent that a fluid can flow through the deformed or punctured wall. As used herein, the term "blocked" means that no fluid flow is flowing through the conduit. As used herein, the term "flow constrained" means that at least 50% of the fluid that was previously flowing through the conduit no longer flows through the conduit. The wall thickness of the sheath 200 can be at least a minimum thickness such that the sheath 200 is capable of withstanding a pressure of at least 500 psi (3.4 megapascals "MPa"), alternatively in the range of about 500 psi to about 12,000 psi (about 3.4 MPa to about 82.7 MPa), alternatively in the range of about 3,000 psi to about 10,000 psi (about 20.7 MPa to about 68.9 MPa). The sheath 200 can be made from a variety of materials. Examples of suitable materials include, but are not limited to, steel, steel alloys, chrome alloys, and high chrome alloys. The material can be selected such that the sheath 200 is capable of withstanding the fluid pressure from the first opening of the conduit 133 that is blocked or flow constrained by a bridge. The material can also be selected based on an anticipated, maximum back pressure should the conduit 133 become blocked due to one or more bridge formations. The anticipated, maximum back pressure can be roughly pre-calculated based on the diameter and total length of the conduit 133, as well as the distance between a bridge formation and the first opening of the conduit 133 that would yield the greatest amount of back pressure.

The methods include the steps of positioning the sand control assembly 130 and the sheath 200 in the open-hole portion of the wellbore 110. The steps of positioning can be performed simultaneously or at different times. The methods can further include the step of positioning one or more packers 122 into the wellbore to form the open-hole portion prior to the step of introducing. The methods include the step of introducing a treatment fluid into the open-hole portion of the wellbore 110. According to an embodiment, the treatment fluid is a gravel pack slurry. According to another embodiment, the treatment fluid is a fracturing fluid. The step of introducing can be pumping the treatment fluid into the open-hole portion of the wellbore 110.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of completing at least a portion of an open-hole wellbore comprising:

positioning a sand control assembly in the portion of the open-hole wellbore, wherein the sand control assembly comprises a screen;

positioning at least one conduit adjacent to the sand control assembly;

positioning a sheath in the portion of the open-hole wellbore, wherein the sheath is a non-porous tubular, and wherein the sheath is positioned such that a sheath annulus exists between the inside wall of the sheath and the outside wall of at least a portion of both, the sand control assembly and the at least one conduit, wherein the at least one conduit is positioned between the inside wall of the sheath and the outside wall of the sand control assembly; and introducing a treatment fluid into at least a portion of a wellbore annulus, wherein the wellbore annulus is the space between the wall of the portion of the open-hole wellbore and the outside diameter of the sheath, wherein the step of introducing is performed after the steps of positioning the sand control assembly, the at least one conduit, and the sheath in the open-hole wellbore.

2. The method according to claim 1, wherein the sand control assembly further comprises a blank pipe.

3. The method according to claim 1, wherein the conduit is aligned co-axially with the sand control assembly.

4. The method according to claim 3, further comprising two or more conduits.

5. The method according to claim 1, wherein the wellbore annulus also includes the space between the wall of the open-hole wellbore and the outside wall of the sand control assembly.

6. The method according to claim 5, wherein the outer diameter of the conduit is smaller than the inner diameter of the wellbore annulus.

7. The method according to claim 1, wherein the conduit comprises a first opening.

8. The method according to claim 7, wherein the first opening is located within the sheath annulus.

9. The method according to claim 8, wherein the first opening is positioned adjacent to the screen.

10. The method according to claim 8, wherein the first opening is positioned adjacent to one or more cross-over tool ports.

11. The method according to claim 10, wherein the length of the sheath is at least sufficient to encircle the cross-over tool ports and the beginning of the screen.

12. The method according to claim 11, wherein the sheath has a length of at least 4 feet.

13. The method according to claim 11, wherein the circumference of the sheath is at least sufficient to encircle at least the cross-over tool ports, the screen, and the conduit.

14. The method according to claim 1, wherein the wall thickness of the sheath is at least a minimum thickness such that the sheath is capable of withstanding a pressure of at least 500 psi (3.4 MPa).

15. The method according to claim 1, wherein the wall thickness of the sheath is at least a minimum thickness such that the sheath is capable of withstanding a pressure in the range of about 3,000 psi to about 10,000 psi (about 20.7 MPa to about 68.9 MPa).

16. The method according to claim 1, wherein the shape of the sheath is tubular.

17. The method according to claim 1, wherein the sheath is made from a material selected from the group consisting of steel, steel alloys, chrome alloys, and high chrome alloys.

18. The method according to claim 17, wherein the material is selected such that the sheath is capable of withstanding the fluid pressure from a first opening of the conduit that is blocked or flow constrained by a bridge.

19. The method according to claim 1, wherein the treatment fluid is a gravel pack slurry.

20. The method according to claim 1, wherein the treatment fluid is a fracturing fluid.

* * * * *